US005097996A

United States Patent [19]

Chen

[11] Patent Number: 5,097,996

[45] Date of Patent: Mar. 24, 1992

[54] CLOTHES HANGER WITH SERIES OF MATING PROJECTIONS AND HOLES ON GRIPPING SURFACE

[76] Inventor: Feng-Yin Chen, No. 90-2, Hai-Pu-Tsuo Lane, Chung-Yang Rd., Lung-Ching Hsiang, Taichung Hsien, Taiwan

[21] Appl. No.: 605,929

[22] Filed: Oct. 30, 1990

[51] Int. Cl.[5] ..... A47G 25/48; A47G 25/14

[52] U.S. Cl. ..... 223/91; 223/95; 223/96; 223/93; 223/85

[58] Field of Search ..... 223/91, 93, 95, 96, 223/85, 88; 24/521, 519, 507, 562; D6/326, 315

[56] References Cited

U.S. PATENT DOCUMENTS

| | | | |
|---|---|---|---|
| 1,087,159 | 2/1914 | Cooper | 24/519 |
| 2,457,026 | 12/1948 | Bergantino | 24/519 |
| 2,556,615 | 6/1951 | De Vaughn | 24/507 X |
| 3,197,095 | 7/1965 | Swanson | 223/96 |
| 3,415,432 | 12/1968 | Caves | 223/96 |
| 4,308,981 | 1/1982 | Miura | 223/96 |
| 4,669,152 | 6/1987 | Alexander | 223/96 X |
| 4,716,634 | 1/1988 | Fan | 223/91 X |

FOREIGN PATENT DOCUMENTS

| | | | |
|---|---|---|---|
| 2536261 | 5/1984 | France | 223/96 |

*Primary Examiner*—Werner H. Schroeder
*Assistant Examiner*—Bibhu Mohanty
*Attorney, Agent, or Firm*—McGlew & Tuttle

[57] ABSTRACT

A clothes hanger of the type having two elongated flat plates which clamp an article of clothing between them. The clamping force coming from two W-shaped metal rods which are squeezed together by the hook which is used to hang the clothes hanger from a rod. The elongated flat plates of the hanger have a plurality of studs and a plurality of holes. The studs on one of the elongated flat plates are staggered with the studs on the other elongated plate. The studs of one elongated flat plate are aligned with the holes on the other elongated flat plate. The combining of the studs and the holes cause a very secure grip on an article of clothing which is placed in between the two flat plates before the flat plates are clamped together.

6 Claims, 6 Drawing Sheets

CLOTHES HANGER WITH SERIES OF MATING PROJECTIONS AND HOLES ON GRIPPING SURFACE

BACKGROUND OF THE INVENTION

The invention relates to a clothes hanger, more particularly, to a clothes hanger which has a means that grips clothing more effectively, so that it is less likely that clothing will fall off unintentionally.

FIG. 1 shows a clothes hanger of the prior art. Accordingly, the clothes hanger includes: a clamp assembly and a pair of contact surfaces, the clamp assembly includes a first substantially W-shaped metal rod (1) with two arms (1*a*), and a generally U-shaped portion (1*c*) interconnected between the two arms; a second substantially W-shaped metal rod (2) with two arms (2*a*), and a generally U-shaped portion interconnected between the two arms (2*a*). The arms of the W-shaped second metal rod (2) are pivotally coiled and engaged to the arms of the W-shaped first metal rod. The two W-shaped metal rods thus assembled, are electro-coated so to appear more attractive.

The contact surfaces, which comprise a pair of elongated plate (4) are attached to the free ends of the arms (1*a*, 2*a*) of the clamp assembly, and arranged in such a way that two central bows (4*a*), one on each plate (4) curve away from each other when the hanger is clamped, see FIG. 2. When the hanger is clamped, the contact surfaces hold an item of clothing between them by friction. To clamp the hanger, one end (3*a*) of a hook (3) is pivotally connected to the U-shaped portion of the W-shaped second metal rod that when the hook is rotated about said U-shaped portion, the hook biases the U-shaped portion of the W-shaped first metal rod to move towards the U-shaped portion of the W-shaped second metal rod, thereby urging the contact surfaces to abut one another forcibly.

Clothing clamped in such hanger may fall off if it is heavy, or if it is blown by a strong wind.

SUMMARY OF THE INVENTION

It is therefore, the main object the present invention is to provide a clothes hanger having a clamping from which articles of clothing may not slip out.

Accordingly, it includes a clamping assembly and a pair of contact surfaces. The clamp assembly includes: two substantially W-shaped metal rods, each has two arms and a generally U-shaped portion interconnected between the two arms. The arms of the W-shaped first metal rod are pivotally coiled and engaged to the arms of the W-shaped second metal rod. A pair of substantially flat plate, each of which has a contact surface with two portions interconnected by an arcuated portion in the middle. The free ends of the W-shaped metal rods are connected to the arcuated portions of the pair of flat plates. This arrangement is identical to the prior art. In this invention, however, each contact surface has has a plurality of studs formed thereon. The studs on each contact surface are staggered so as to mesh with the studs on the other side.

The hanger is clamped like the prior art model, but in the present invention, the clothing is held more securely because it is caught in the studs.

BRIEF DESCRIPTION OF THE DRAWINGS

Other features and advantages of the present invention will become apparent in the following detailed description, including drawings, all of which show a non-limiting form of the present invention, and of which.

DETAILED DESCRIPTION OF THE PREFERRED EMBODIMENT

Figure 1:
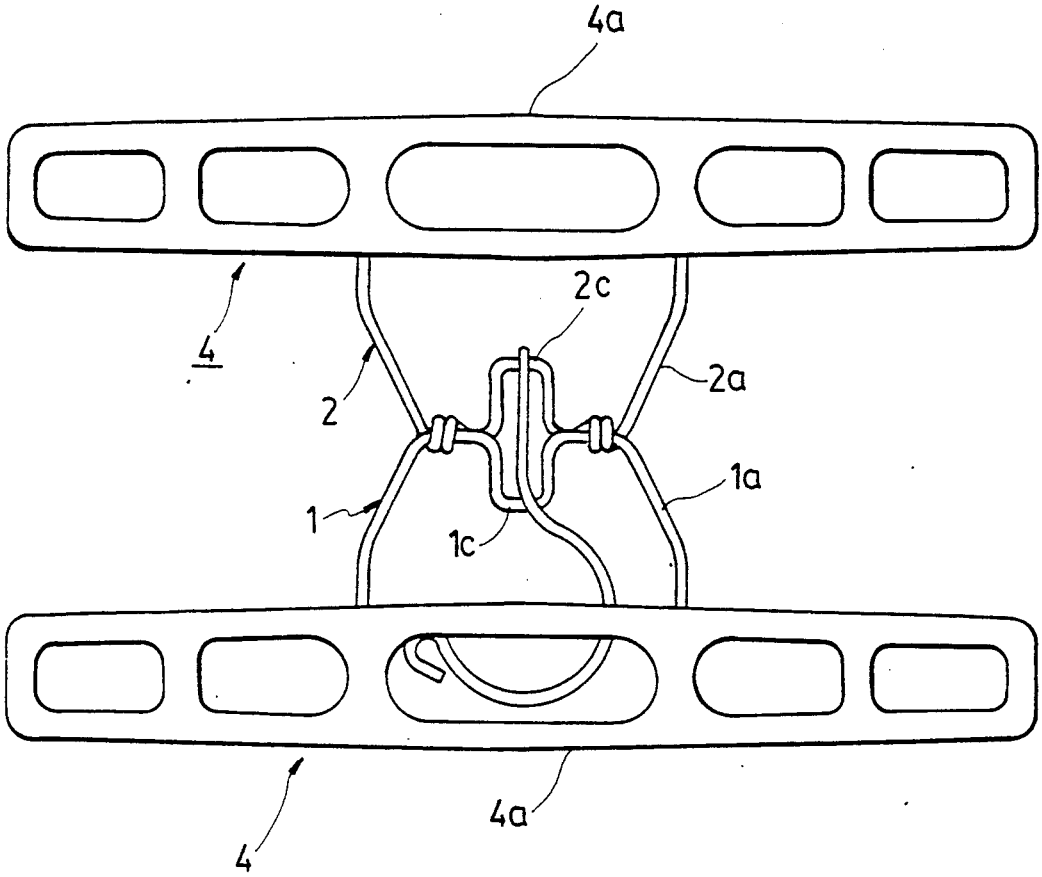
FIG.1 PRIOR ART
FIG. 1 shows a clothes hanger of the prior art in a stretch-out position.
Figure 2:
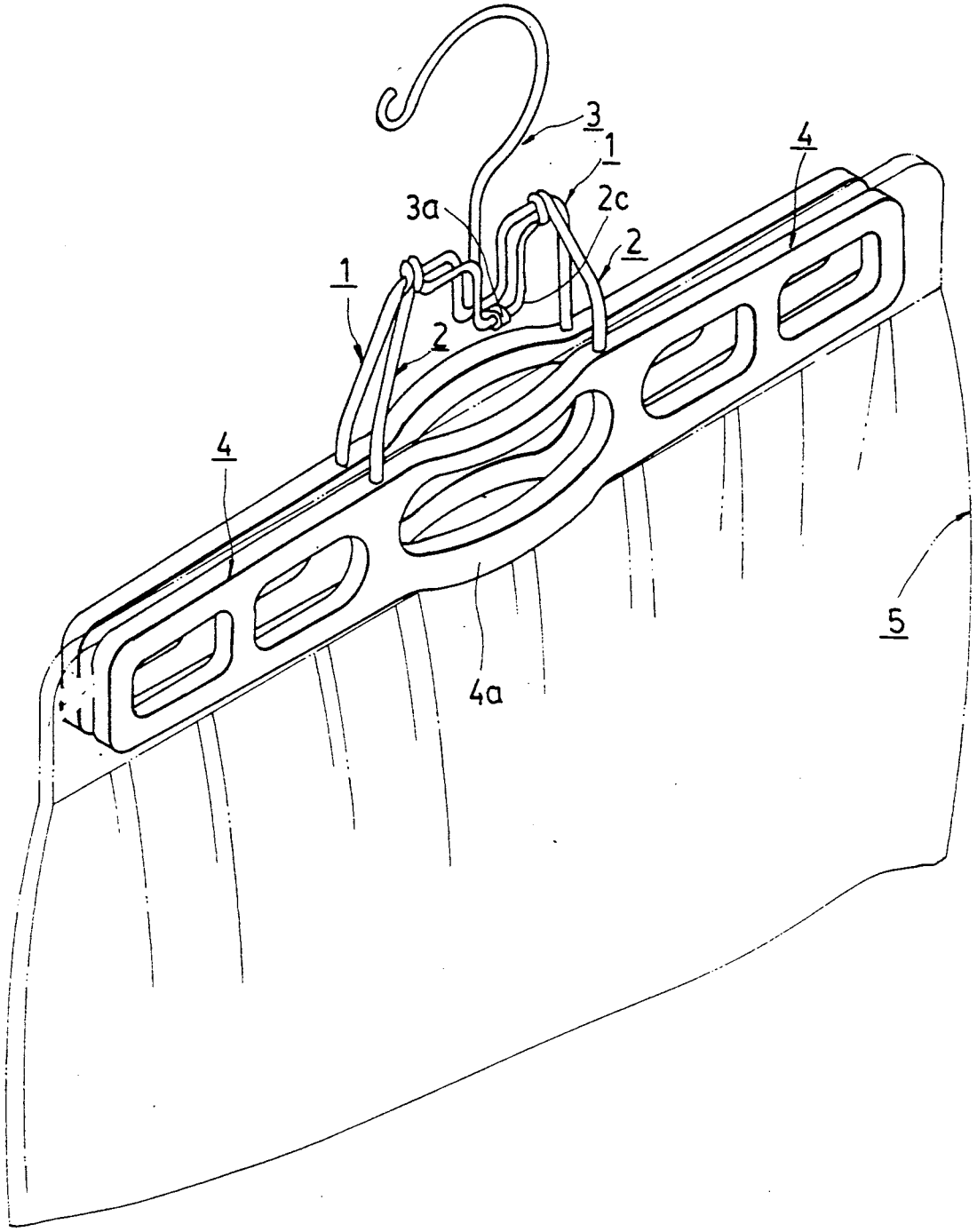
FIG. 2 PRIOR ART
FIG. 2 shows the hanger of FIG. 1 holding a skirt.
Figure 4:
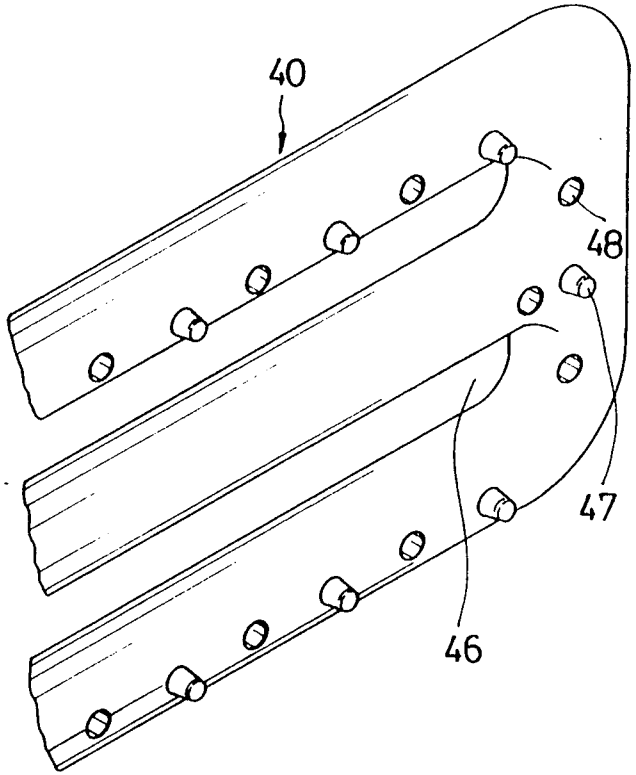
FIG. 4 is an enlarged view of a preferred embodiment of a clothes hanger, according to the present invention.
Figure 3:
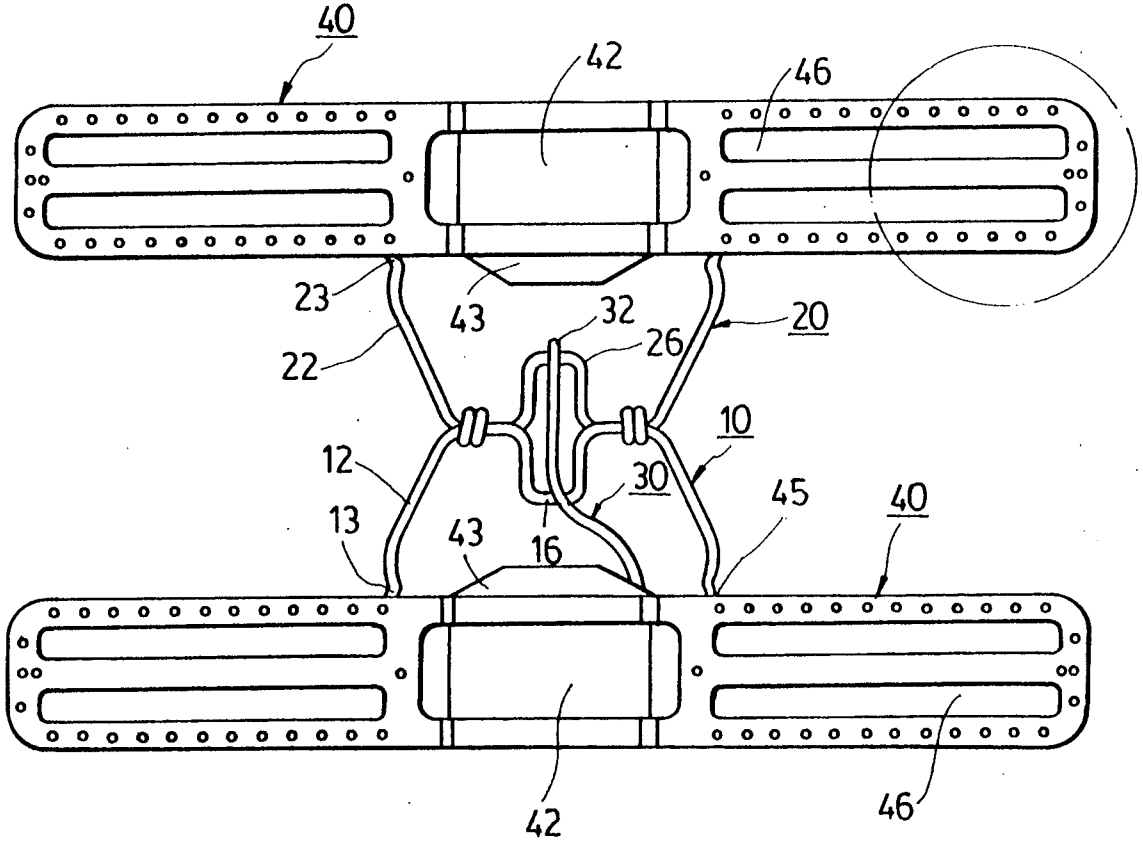
FIG. 3 shows a clothes hanger of the present invention in an open position.
Figure 6:
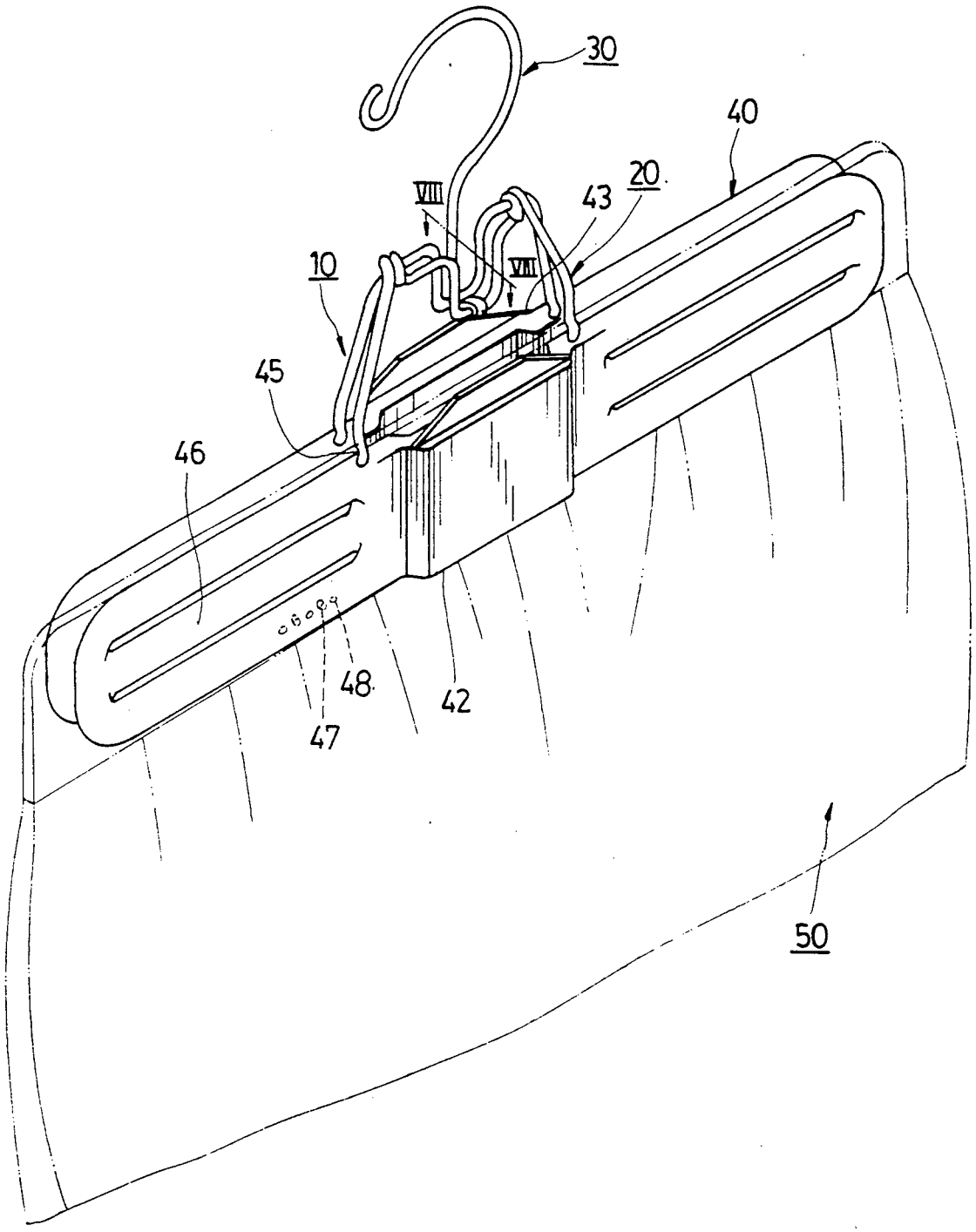
FIG. 6 shows a clothes hanger holding a skirt by the studs on the pair of contact surfaces, according to the present invention.
Figure 7:
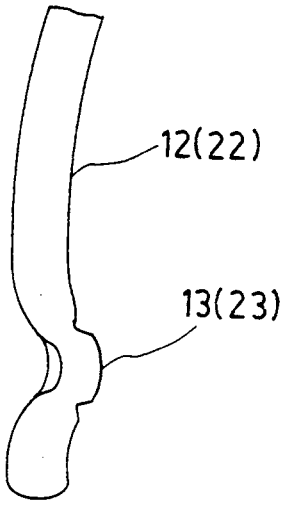
FIG. 7 shows an enlarged view of the arms.

Referring to FIGS. 3, 4 and 6, a clothes hanger of the present invention includes a clamp assembly and a pair of contact surfaces. The clamp assembly includes a substantially W-shaped first metal rod (10) which has two arms (12) and a generally U-shaped portion (16) interconnected between the two arms. A substantially W-shaped second metal rod (20) also has two arms (22) and a generally U-shaped portion (26) interconnected between the two arms. The arms (22) of the W-shaped second metal rod (20) are pivotally coiled and engaged to the arms (12) of the W-shaped first metal rod (10). Each of the arms (12, 22) has a protrusion (13, 23) adjacent to its free end thereof. FIG. 7 shows an enlarged view of the arms (12, 22). The two W-shaped metal rods, thus assembled, are electro-coated so as to appear more attractive.

Each of two elongated plates (40), has a flat contact surface (46), includes two portions interconnected by an arcuated portion (42) in the middle. Two holes (45) are formed on each of the arcuated portions of the pair of elongated plates, into which are inserted the free ends of the arms of the W-shaped metal rods. The protrusions (13, 23) of the arms fit in the holes, and prevent the elongated plates from falling off the same. The elongated plates are mostly made of plastic material. Each of the contact faces also has a plurality of holes (48) and a plurality of truncated cone shaped studs (47) formed longitudinally thereon. The studs (47) on one of the contact surface are aligned with the holes (48) on the other contact surface. Each of the elongated plates also has an reinforcing plate (43) on the upper portion of the arcuated portion (42).

Figure 5:
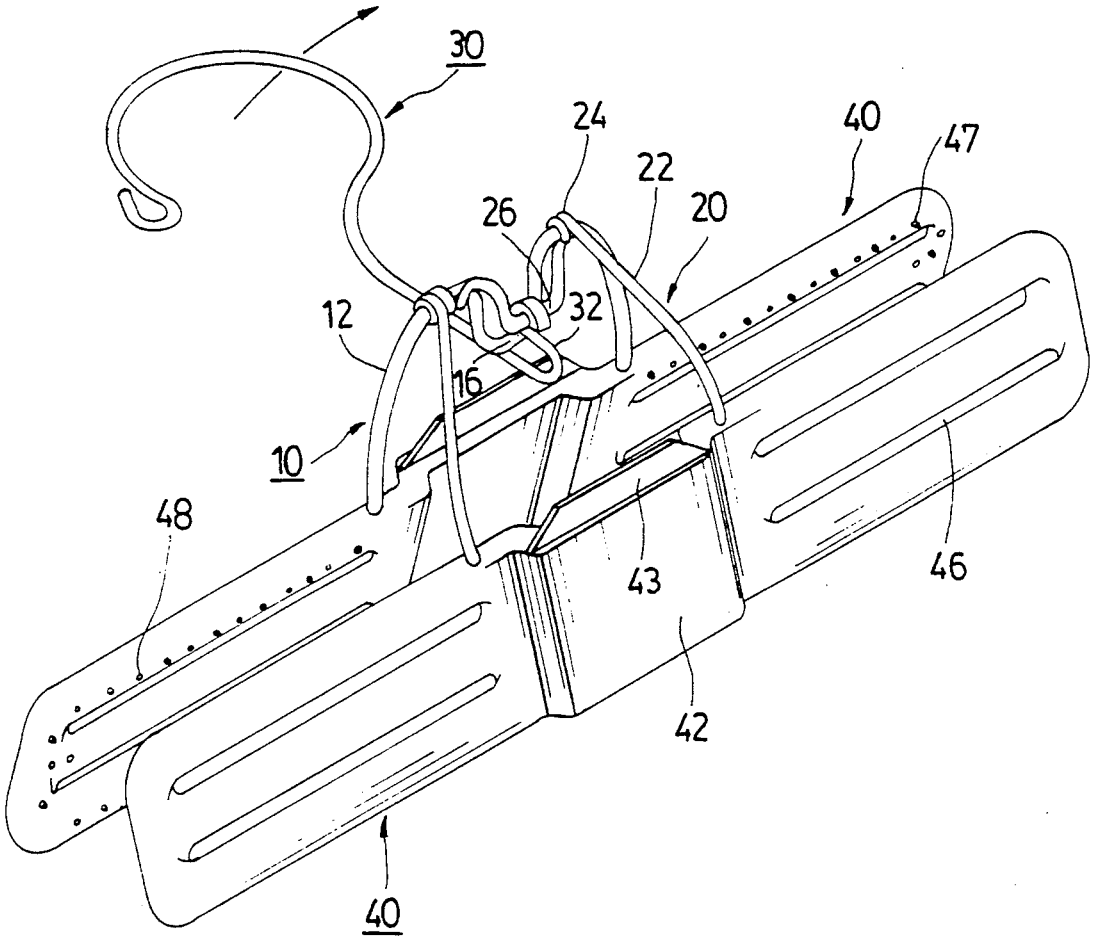
FIG. 5 is a perspective view of a clothes hanger of the present invention showing the configuration of the clamping means.
Figure 8:
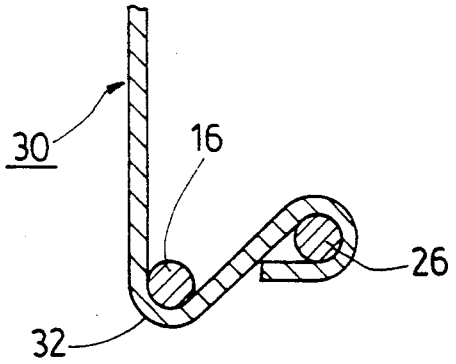
FIG. 8 shows enlarged and detailed view of FIG. 6 along the line VIII—VIII.

One end (32) of a hook (30) is pivotally connected to the U-shaped portion (26) of the W-shaped second metal rod (20). Just by rotating the hook (30) about said U-shaped portion (26) as shown in FIG. 5, the hook (30) will urge the U-shaped portion (16) of the W-shaped first metal rod (10) to move toward the U-shaped portion (26), as shown in FIG. 8, so as to urge the studs and the holes on one of the contact surface abut against the holes and the studs on the other contact surface. FIG. 6 shows a hanger of the present invention, clamping an article of clothing (50), such as a skirt, as explained in above manner. The clothing thus clamped, can not easily slip out, as in the prior art.

With the invention thus explained, it is obvious to those skilled in the art that various modifications and variations can be made without departing from the scope and spirit of the present invention, it is therefore intended that the invention be limited as indicated in the appended claims only.

I claim:

1. A clothes hanger comprising:

a substantially W-shaped first metal rod with two arms, and a generally U-shaped portion interconnected between said two arms;

a substantially W-shaped second metal rod formed of two arms and a generally U-shaped portion interconnected between said two arms, said two arms of said W-shaped second metal rod respectively and pivotally connected to said two arms of said W-shaped first metal rod;

a pair of elongated plates, each of said elongated plates having a flat contact surface;

said arms of said first and said second W-shaped metal rods being respectively attached to intermediate portions of said elongated plates;

a hook having an end pivotally connected to said U-shaped portion of said W-shaped second rod, said hook biasing said U-shaped portion of W-shaped first metal rod to move towards said U-shaped portion of said W-shaped second metal rod when said hook is rotated about said U-shaped portion of said W-shaped second metal rod, thereby urging said contact surfaces of said elongated plates to abut against one another;

each of said flat contact surfaces of said elongated plates having a plurality of truncated cone shaped studs formed thereon, said plurality of truncated cone shaped studs on one of said flat contact surface being staggered with said plurality of truncated cone shaped studs on the other said flat contact surface, wherein when said hook is rotated, biasing said U-shaped portion of said W-shaped second metal rod to move towards said U-shaped portion of said W-shaped first metal rod, a clamping force is generated between said contact surfaces by said truncated cone shaped studs.

2. A clothes hanger as claimed in claim 1, wherein said contact surfaces of said elongated plates further comprises a plurality of holes formed therein, said plurality of holes on one of said contact surface being staggered with said plurality of holes on other said contact surface but aligned with said plurality of truncated cone shaped studs on the other said contact surface.

3. A clothes hanger as claimed in claim 1, wherein each of said arms of said W-shaped metal rods has a protrusion adjacent to the free end of said W-shaped metal rods, each of said elongated plates having two holes in an intermediate portion of the said elongated plates, said arms of said W-shaped metal rods being inserted in said holes of said elongated plates and engaged therein by said protrusions.

4. A clothes hanger comprising:

a substantially W-shaped first metal rod formed of two arms, and a generally U-shaped portion interconnected between said two arms, each of said arms of said W-shaped first metal rod having a protrusion adjacent to a free end of said W-shaped metal rods;

a substantially W-shaped second metal rod with two arms and a generally U-shaped portion interconnected between said two arms, said two arms of said W-shaped second metal rod respectively and pivotally connected to said two arms of said W-shaped first metal rod, each of said arms of said W-shaped second metal rod having a protrusion adjacent to a free end of said W-shaped metal rods;

a pair of elongated plates, each of said elongated plates having a flat contact surface, each of said elongated plates having two holes in an intermediate portion of said elongated plates, said arms of said W-shaped metal rods being inserted in said holes of said elongated plates and engaged therein by said protrusions;

a hook having an end pivotally connected to said U-shaped portion of said W-shaped second rod, said hook biasing said U-shaped portion of W-shaped first metal rod to move towards said U-shaped portion of said W-shaped second metal rod when said hook is rotated about said U-shaped portion of said W-shaped second metal rod, thereby urging said contact surfaces of said elongated plates to abut against one another; and stud means on said flat contact surfaces for engaging and firmly holding an article of clothing between said flat contact surfaces when said contact surfaces are abutted against each other, said stud means having a plurality of truncated cone shaped studs positioned in a plurality of rows on each of said flat contact surfaces, said stud means also defining a plurality of holes ultimately positioned between said truncated cone shaped studs in order for said truncated cone shaped studs to enter into said holes when said flat contact surfaces are abutted against each other.

5. A clothes hanger, comprising:

a clamp assembly including a first clamp assembly portion and a second clamp assembly portion;

a first plate connected to said first clamp assembly portion defining an intermediate plate surface, an upper outer plate surface and a lower outer plate surface, open portions being formed between said intermediate plate surface and said upper outer plate surface and between said intermediate plate surface and said lower outer plate surface, a plurality of studs and a plurality of stud receiving holes, each stud alternating with each receiving hole to form a row of studs and holes, a first row of studs and holes being provided along said upper outer plate surface and a second row of studs and holes being provided along said lower outer plate surface, said first plate including a first side surface connecting said lower outer surface, said upper outer surface and said intermediate plate surface and a second side surface connecting said upper outer surface, said lower outer surface and said intermediate plate surface, a cluster of at least one stud and at least one hole being provided on said first side surface and a cluster of at least one stud and at least one hold being provided on said second side surface;

a second plate connected to said second clamp assembly portion defining an intermediate plate surface, an upper outer plate surface and a lower outer plate surface, open portions being formed between said intermediate plate surface and said upper outer plate surface and between said intermediate plate surface and said lower outer plate surface, a plurality of studs and a plurality of stud receiving holes, each stud alternating with each receiving hole to form a row of studs and holes, a first row of studs and holes being provided along said upper outer plate surface and a second row of studs and holes being provided along said lower outer plate surface, said second plate including a first side surface connecting said lower outer plate surface, said upper outer plate surface and said intermediate surface and a second side surface connecting said upper outer plate surface said lower outer plate surface and said intermediate plate surface, a cluster of at least one stud and at least one hole being provided on said first side surface and a cluster of at least one stud and at least one hold being provided on said second side surface.

6. A hanger according to claim 5, wherein said first plate and said second plate each include a first intermediate side surface and a second intermediate side surface, said first intermediate side surface connecting said upper outer plate surface, said intermediate plate surface and said lower outer plate surface and said second intermediate side surface connecting said upper outer plate surface, said intermediate plate surface and said lower outer surface and cooperating with said first intermediate side surface to define a central arcuated opening portion, said first intermediate side surface and said second intermediate side surface each including one of a stud or a stud hole.

* * * * *